United States Patent [19]

Viets et al.

[11] Patent Number: 4,491,254

[45] Date of Patent: Jan. 1, 1985

[54] LIQUID CHEMICAL APPLICATOR

[75] Inventors: Alan K. Viets; James D. Amerine, both of Marysville; Henry M. Lowe, Ostrander, all of Ohio

[73] Assignee: The O. M. Scott and Sons Company, Marysville, Ohio

[21] Appl. No.: 421,122

[22] Filed: Sep. 22, 1982

[51] Int. Cl.[3] ..... B05B 7/30

[52] U.S. Cl. ..... 222/83.5; 222/630; 239/307; 239/315; 239/318

[58] Field of Search ..... 222/129, 145, 394, 395, 222/400.7, 544, 547, 564, 630, 83.5, 80, 81, 83, 88, 541; 239/307, 309, 310, 315, 318, 317, 407, 419.3, 427.5, 427.3, 316

[56] References Cited

U.S. PATENT DOCUMENTS

| | | | |
|---|---|---|---|
| 2,006,437 | 7/1935 | Burgess et al. . | |
| 2,536,361 | 1/1951 | Flanders | 222/630 |
| 2,580,629 | 1/1952 | Wenzel . | |
| 2,599,678 | 6/1952 | Walker . | |
| 2,711,928 | 6/1955 | Randa . | |
| 2,760,820 | 8/1956 | Cirese . | |
| 3,104,823 | 9/1963 | Hayes . | |
| 3,123,253 | 3/1964 | Lambton . | |
| 3,181,797 | 5/1965 | Hayes . | |
| 3,255,924 | 6/1966 | Modderno . | |
| 3,443,726 | 5/1969 | Muller et al. | 222/541 |
| 3,499,606 | 3/1970 | Smith . | |
| 3,833,177 | 9/1974 | Pesley et al. . | |
| 3,993,245 | 11/1976 | Smith . | |
| 4,027,822 | 6/1977 | Usher . | |
| 4,250,911 | 2/1981 | Kratz . | |
| 4,382,552 | 5/1983 | Lubsen et al. | 239/318 |
| 4,385,034 | 5/1983 | Gacer | 239/317 X |

*Primary Examiner*—Joseph J. Rolla
*Assistant Examiner*—Frederick R. Handren
*Attorney, Agent, or Firm*—James B. Raden; Harold J. Holt

[57] ABSTRACT

A liquid applicator for dispensing a chemical, such as a herbicide, in dilute aqueous form. The applicator has a first container adapted to contain a concentrated chemical and a second container adapted to receive chemical from the first container prediluted with water. A valve controls the flow of chemical and water from the first to the second container and controls the flow of water to an aspirator which further dilutes and discharges the chemical.

9 Claims, 7 Drawing Figures

LIQUID CHEMICAL APPLICATOR

This invention relates to a liquid applicator for dispensing a chemical in dilute aqueous form.

Typical hose end lawn or garden sprayers are aspirator units which apply fertilizers, pesticides or other chemicals at a fixed, low dilution ratio. To utilize concentrates which must be diluted to high ratios, the user normally predilutes the concentrate with water. This is accomplished by volume measurement of the concentrate with a spoon, cap or other measuring device into a sprayer mix jar. Water is then added to obtain the proper premix concentration. The prediluted concentrate is then further diluted to its final dilution ratio as the sprayer is operated.

Such predilution procedures require the manual handling of concentrated chemicals with its attendant risks. Moreover, the user must generally purchase the concentrate in larger quantities than are necessary for a single application and thus containers of the concentrated chemical must be stored for extended periods after they have been opened. On the other hand devices which attempt to avoid predilution by diluting the concentrate at a high ratio in one step are not satisfactory because of very poor accuracy.

The concept of two-step mixing or dilution of chemicals, including such use in spraying devices is known. See, for example, U.S. Pat. Nos. 2,006,437; 2,599,678; 2,711,928; 2,760,820; 3,104,823; 3,181,797; 3,499,606; and 4,027,822. However, the devices shown in these patents are either cumbersome or otherwise unsuitable for garden spray devices.

Devices for adding a liquid additive to a flow of fluid by use of a container of a concentrated chemical having a rupturable seal are also known. U.S. Pat. Nos. 3,833,177 and 3,993,245 show two such devices. Other patents which show devices for delivering mixtures of chemicals and which utilize containers having a rupturable seal are U.S. Pat. Nos. 2,580,629; 3,123,253; 3,255,924 and 4,250,911. However, the devices shown in these patents are not adapted to overcome the problem of high dilution ratios.

It is accordingly a primary object of this invention to provide a liquid applicator for dispensing a chemical at high but yet accurate dilution ratios.

It is a further object of this invention to provide a liquid applicator device which performs a two-stage dilution of a chemical without the necessity of manual intervention or physical contact with the chemical by the user.

The foregoing and other objects of the invention are achieved in a liquid applicator for dispensing a chemical in dilute aqueous form comprising an applicator body containing a first passageway therethrough for the passage of water from a water source to the exterior of the applicator, a first container connected with said applicator body adapted to contain a chemical therein, a second container connected with said applicator body adapted to contain a chemical diluted with water, said applicator body containing a second passageway for passage of chemical and water from said first container to said second container, valve means intersecting said first passageway adapted to divert water from said first passageway into said first container to flush chemical from said first container into said second container and predilute said chemical with water, said first passageway containing an aspirator therein for withdrawal and further dilution of prediluted chemical from the second container and for discharge of said diluted chemical from the applicator.

The invention will be better understood by reference to the accompanying drawing in which.

The applicator comprises an applicator body 1, a first container 2 and a second container 3, both containers connected by threaded engagement with the applicator body 1. Container 2 is mounted in inverted position on the applicator while container 3 is mounted in upright position vertically beneath container 2. Container 2 is adapted to contain a premeasured amount of a concentrated chemical, as for example, a herbicide, insecticide, other pesticide or fertilizer. Container 2 may actually take the form of a cartridge or vial. Container 3, on the other hand, will normally be of larger size than container 2 and is adapted to contain chemical from container 2 prediluted with water. The applicator also contains a conventional nozzle 4 in threaded engagement at one end thereof with the applicator body and adapted at its other end to connect with a source of water to control the passage of water through the applicator. Any suitable on-off valve means could of course replace the nozzle to control the flow of water from an outside source into the applicator.

Figure 1:
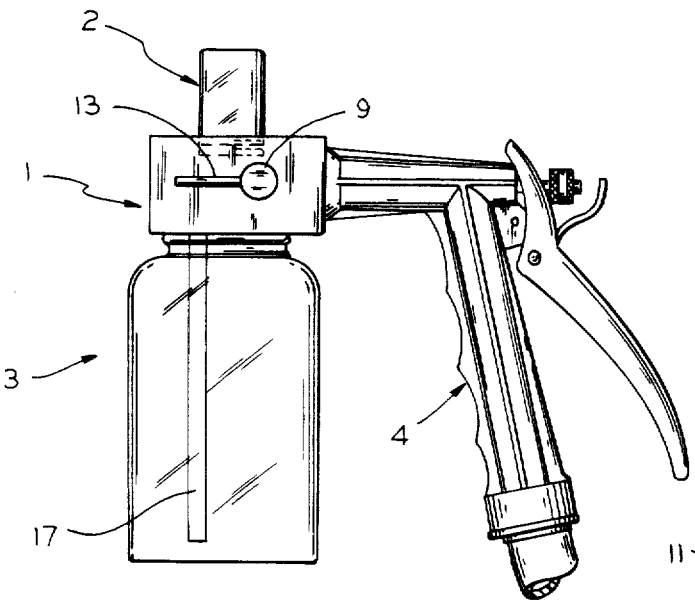
FIG. 1 is an elevational view of one embodiment of a liquid applicator in accordance with the invention.
Figure 2:
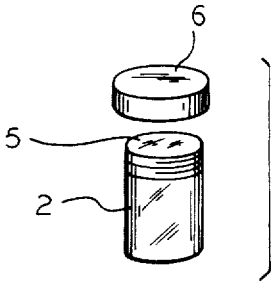
FIG. 2 is a perspective view of a container for concentrated chemical.

As shown in FIG. 2, the container 2 contains a rupturable seal 5 across its opening and a cap 6 for threaded engagement and closure of the container. The seal 5 may be conveniently made of plastic and prevents escape of chemical from the container after removal of cap 6 and during attachment of the container to the applicator.

Figure 6:
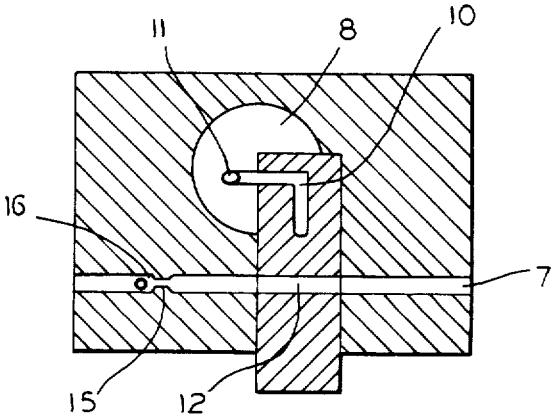
FIG. 6 is a sectional view along the lines 6—6 of FIG. 5 showing the applicator valve in operating or spray position.
Figure 7:
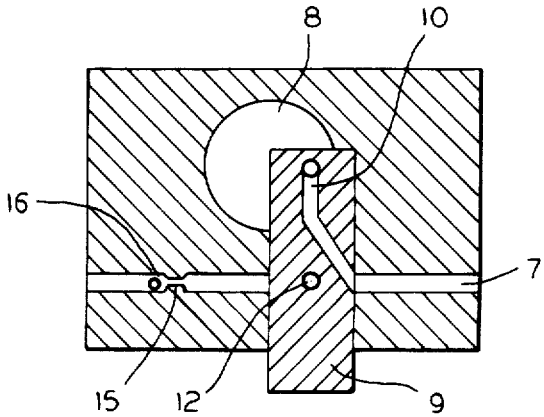
FIG. 7 is a sectional view similar to FIG. 6 but showing the valve in mix position.

The applicator body contains a first passageway 7 extending horizontally across the applicator for the passage of water from the nozzle end to the exit end of the applicator. The applicator also contains a second, larger passageway 8 extending vertically through the applicator body for the passage of chemical and water from container 2 to large container 3. Mounted horizontally within the applicator body at right angles to both passageways 7 and 8 is a rotatable valve means 9. The valve 9 intersects the passageway 7 and protrudes into a vertical passageway 8. Valve 9 contains a tubular member 10 partially embedded within the valve and partially protruding from the valve into passageway 8, the protruding portion having a sharp extremity 11. Valve 9 also contains a hole 12 therethrough and a handle 13 for rotation of the valve. Upon rotation of the valve to a first position of rotation, that shown in FIG. 7, tubular member 10 aligns at the non-projecting end thereof with the water entrance end of passageway 7 while the projecting end of the tubular member faces upwardly in passageway 8 toward the open end of container 2. Upon rotation of the valve to a second position of rotation, that shown in FIG. 6, both ends of the hole 12 align with and complete horizontal passageway 7 to form a continuous passage from entrance to exit end of the applicator.

Passageway 7 contains an aspirator, generally designated by the numeral 14, at an intermediate position along its length. Aspirator 14 comprises a horizontally disposed venturi consisting of a high velocity passageway portion 15 and a portion 16 of larger diameter and reduced velocity. The aspirator also comprises a vertically disposed tube 17 extending into large container 3.

Figure 3:
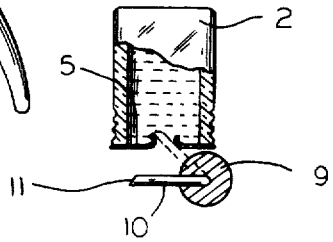
FIG. 3 is a fragmentary sectional view of the container and applicator valve viewed along the lines 3—3 of FIG. 4 to show the manner in which the rupturable seal is broken.
Figure 4:
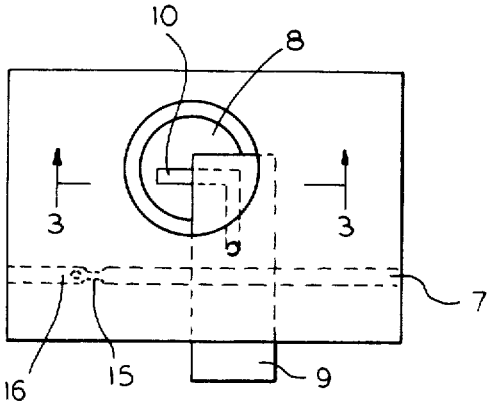
FIG. 4 is a plan view of the applicator body.
Figure 5:
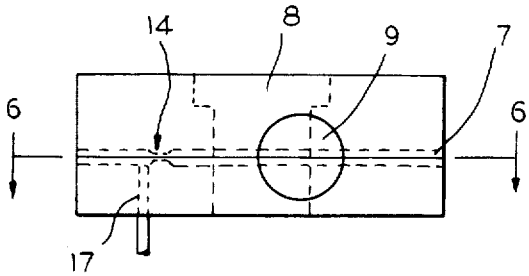
FIG. 5 is an elevational view of the applicator body.

In operation, the applicator is connected to a garden hose or other water source through nozzle 4. Cap 6 is then removed from container 2 containing a concentrated chemical. Container 2 with seal 5 intact is threaded in inverted position into applicator body 1. Handle 13 is rotated so that the projecting end of tubular member 10 punctures seal 5, as illustrated in FIG. 3. In this position, the non-projecting end of tubular member 10 will be in alignment with the water entrance end of passageway 7. Water, permitted to enter through nozzle 4 into passageway 7, is diverted through tubular member 10 into first container 2 to flush chemical from container 2 into container 3 and at the same time predilute the chemical with water. Container 3 is then filled with the entire contents of container 2 diluted with sufficient water to either fill container 3 completely or to partially fill container 3 to a preselected level. Handle 13 is then rotated to align valve 9 in the position shown in FIGS. 4, 5 and 6 wherein hole 12 is in registry with the remaining portions of passageway 7. Water from the water source then flows across the aspirator 14, mixes with and further dilutes the premixed chemical and discharges the completely diluted chemical, normally as a spray, from the exit end of passageway 7.

Virtually any type of chemical concentrate designed for use in water can be used with the applicator of the invention. This includes solutions, emulsions, emulsifiable concentrates, suspensions, wettable powders and dry flowable chemicals. While the applicator may be used for a variety of end uses, it is particularly intended for use as a hose end lawn or garden sprayer for the delivery of pesticides or fertilizers.

We claim:

1. A liquid applicator for dispensing a chemical in dilute aqueous form comprising an applicator body containing a first passageway therethrough for the passage of water from a water source to the exterior of the applicator, a first container connected with said applicator body adapted to contain a chemical therein, a second container mounted vertically beneath said first container on said applicator body and adapted to contain a chemical diluted with water, said applicator body containing a second passageway for passage of chemical and water by gravity from said first container to said second container, valve means intersecting said first passageway adapted to divert water from said first passageway into said first container to flush chemical from said first container into said second container and predilute said chemical with water, said first passageway containing an aspirator therein for withdrawal and further dilution of prediluted chemical from the second container and for discharge of said diluted chemical from the applicator.

2. The applicator of claim 1 in which the first container contains a rupturable seal across the opening thereof for containing the chemical therein.

3. The applicator of claim 2 in which said valve means includes a projecting tubular member through which water is diverted from said water source into said first container to flush chemical therefrom.

4. The applicator of claim 3 in which said valve means is a rotatable member having a first position of rotation in which water is diverted through said tubular member into said first container and a second position of rotation in which water passes through said aspirator to discharge diluted chemical from the second container.

5. The applicator of claim 3 in which said projecting tubular member contains a sharp extremity thereof which is adapted to rupture said seal.

6. The applicator of claim 3 having means in combination with said applicator body to control the passage of water into said applicator.

7. The applicator of claim 4 in which said valve means is mounted for rotation within said applicator body at right angles to the first and second passageways.

8. The applicator of claim 4 in which the tubular member at its non-projecting end is adapted for alignment, in said first position of rotation of said valve, with the water entrance end of said first passageway.

9. The applicator of claim 4 in which said valve means contains a hole therethrough adapted for alignment at both ends thereof, in said second position of rotation, with said first passageway.

* * * * *